US010906692B2

(12) United States Patent
Lim

(10) Patent No.: US 10,906,692 B2
(45) Date of Patent: Feb. 2, 2021

(54) TIELESS FLATWARE DISPLAY PACKAGING

(71) Applicant: Gourmet Settings Inc., Richmond Hill (CA)

(72) Inventor: Johnny Lim, Richmond Hill (CA)

(73) Assignee: Gourmet Settings Inc., Richmond Hill (CA)

( * ) Notice: Subject to any disclaimer, the term of this patent is extended or adjusted under 35 U.S.C. 154(b) by 54 days.

(21) Appl. No.: 16/434,034

(22) Filed: Jun. 6, 2019

(65) Prior Publication Data

US 2020/0087023 A1 Mar. 19, 2020

(30) Foreign Application Priority Data

Sep. 18, 2018 (CA) ..... 3017870

(51) Int. Cl.
*B65D 1/34* (2006.01)
*B65D 5/50* (2006.01)
*A47F 7/00* (2006.01)

(52) U.S. Cl.
CPC ..... *B65D 5/509* (2013.01); *A47F 7/0007* (2013.01); *A47F 7/0028* (2013.01)

(58) Field of Classification Search
CPC ..... B65D 5/509; A47F 7/0007; A47F 7/0028; A47G 21/14
USPC ..... 206/553, 477, 480, 482, 483, 485, 560, 206/564, 565
See application file for complete search history.

(56) References Cited

U.S. PATENT DOCUMENTS 2,366,046 A * 12/1944 Naken ..... A45C 13/02 206/527
2,652,921 A 9/1953 Foster
2,807,361 A * 9/1957 Junkin ..... B65D 5/504 206/553
3,135,383 A * 6/1964 Bloch ..... A47G 21/14 206/553

(Continued)

FOREIGN PATENT DOCUMENTS

CN 103708112 A 4/2014

OTHER PUBLICATIONS

T.G. & Son Corp. Ltd., EVA/EPE FOAM Manufacturer, accessed on May 17, 2018, available on: <https://www.tgandson.com/materials.htm>.

(Continued)

*Primary Examiner* — Luan K Bui
(74) *Attorney, Agent, or Firm* — Patterson + Sheridan, LLP

(57) ABSTRACT

A tieless package is provided for displaying flatware pieces. The package has a rigid paperboard box. Sized to fit snugly within this box is a formed backer. The backer has a display panel surface and at least one recessed area and an insert recess running across the recessed area. A resilient foam insert is securely set into the insert recess. This insert has shaped slots for inserting individual flatware pieces. Each shaped slot has: a relatively narrow neck, and a relatively wider holding area under the narrow neck. An individual flatware piece is inserted into the slot by squeezing the piece through the relatively narrow neck to seat the piece in the wider holding area, and the foam of the slot's narrow neck recloses over the individual flatware piece after insertion to capture it in the holding area.

18 Claims, 10 Drawing Sheets

(56) References Cited

U.S. PATENT DOCUMENTS

| | | | | | |
|---|---|---|---|---|---|
| 4,305,629 | A * | 12/1981 | Friis | A47G 21/14 | 312/204 |
| 4,979,610 | A * | 12/1990 | Thomas | A45C 11/24 | 206/553 |
| 5,375,700 | A | 12/1994 | Joss et al. | | |
| 5,492,671 | A * | 2/1996 | Krafft | A61L 2/06 | 422/26 |
| 5,772,031 | A * | 6/1998 | Landis | A61B 50/30 | 206/363 |
| 7,173,070 | B2 | 2/2007 | Koffler | | |
| 2008/0073241 | A1* | 3/2008 | Naden | B65D 25/06 | 206/553 |
| 2008/0184674 | A1 | 8/2008 | Hall et al. | | |
| 2014/0325847 | A1 | 11/2014 | Woolery | | |

OTHER PUBLICATIONS

Dongguan Yuanfeng Plastic Products Co., Ltd., Custom Bottle Foam Insert Bottle Protective Packing, accessed on May 17, 2018, available on: <https://www.alibaba.com/product-detail/Custom-Bottle-Foam-Insert-Bottle-Protective_60748759567.html?spm=a2700.7724838.2017115.277.1f0947f25YNihQ>.

Topline Promotions. BBQ Multi Tool, accessed on May 17, 2018, available on: <http://products.toplinepromotions.com.au/bbq-multi-tool-PS0052845>.

* cited by examiner

TIELESS FLATWARE DISPLAY PACKAGING

CROSS-REFERENCE TO RELATED APPLICATIONS

This application claims benefit of Canadian Patent Application Number 3,017,870, filed Sep. 18, 2018, which is herein incorporated by reference.

FIELD OF THE INVENTION

The invention relates to packaging systems for flatware (eating and/or serving utensils) and more particularly relates to packaging systems that also permit the flatware to be displayed.

BACKGROUND

Description of the Related Art

In the past, flatware (e.g. silver flatware) was displayed and packaged separately. A consumer shopped for flatware by selecting pieces that were displayed as "open" stock in a store (typically on a shelf lying flat or at a slight angle where the piece could be picked up, studied closely, handled, etc.), typically under the close eye of store personnel. Once a pattern was selected, the consumer would pay for and bring home a closed box of bundled pieces, separate from the store display stock. Storage boxes (e.g. wooden flatware chests, as shown in FIG. 1) were sold separately, and the set of flatware purchased by the consumer could be arranged in the storage box for long term keeping. To ensure that all of the pieces of the set were present and accounted for, the storage box might have individual grooves or slots B or sleeves A where the individual pieces or subsets of pieces C could be placed. As seen in FIG. 1 and its inset, such storage boxes traditionally had layers of fabric or felt in the interior to provide a clean, non-marring and noise- and rattle-damping surface for the flatware pieces.

More recently, sets of flatware, like many other consumer products, are sold in non-"showroom" conditions. They may come packaged in clear front display boxes, in which at least one set of pieces is arrayed so that the consumer can easily see the individual pieces (as shown in FIG. 2). To facilitate viewing in an upright configuration, the individual pieces D are typically strapped to a display backer F inside the box G using tape, strings, wire twist ties, elastic bands, or rigid cable ties E (and very often, combinations of these strapping methods). Other pieces may be retained in bags or bundles behind this backer (not shown). Heavier and at times more dangerous than other consumer products, flatware needs a considerable amount and strength of such ties to retain the pieces securely and prevent theft and/or injury while in retail.

From the consumer perspective, such methods of strapping require extensive "fiddling" with the ties/straps to remove the pieces, which delays the gratification of physically handling, admiring and using the product. This causes well-known consumer frustration (sometimes called "wrap rage"). The ties may be nearly invisible (e.g. some tapes and fine strings or elastics), which adds to the difficulty in removing them by cutting or untying them. In the case of wire or cable ties, the consumer can also cause injury to him/herself or the piece as s/he struggles to cut the tie/strap with a knife, box cutter or scissors.

There is also an environmental toll of each of these methods, as they create a pile of garbage in the form of pieces of non-recyclable strap and destroyed or damaged packaging.

It would be advantageous to provide a method of displaying such pieces in a reuseable display package providing secure retention of the pieces in the box but without ties.

SUMMARY OF THE INVENTION

According to a first aspect of the invention, a tieless package is provided for displaying flatware pieces. The package has a rigid paperboard box. Sized to fit snugly within this box is a formed backer. The backer has a display panel surface at a first depth in the box; and at least one recessed area having a longitudinal dimension and a latitudinal dimension and having a second depth deeper than the first depth; and an insert recess running across the recessed area in the latitudinal dimension and having a depth equivalent to the second depth. A resilient foam insert is securely set into the insert recess which extends approximately between the first depth and the second depth. This insert has shaped slots for inserting individual flatware pieces. Each shaped slot has: a relatively narrow neck proximate to the first depth, and a relatively wider holding area under the narrow neck below the first depth but terminating before the second depth. An individual flatware piece is inserted into the slot by squeezing the piece through the relatively narrow neck to seat the piece in the wider holding area, and the foam of the slot's narrow neck recloses over the individual flatware piece after insertion to capture it in the holding area.

Preferably, the backer is of polystyrene. More preferably, the backer is of vacuum formed polystyrene. Preferably, the insert is of ethylene vinyl acetate (EVA) foam. Preferably, the insert is of EVA foam having a density of at least 0.1 g/cm$^2$. More preferably, the insert is of EVA foam having a density of at least 0.15 g/cm$^2$.

Each insert may have multiple slots. The slots of an individual insert may be matching. The slots may be waterjet or die-cut.

Preferably, the holding area of the slot is sized to fit a portion of the individual piece within the recess.

Preferably, the backer has a plurality of recessed areas, each having at least one insert in at least one insert recess, and each recessed area is for a grouping or type of flatware. Preferably, at least two of the inserts have non-matching slots.

Preferably, the package includes slots for all individual pieces of a set of flatware.

Preferably, the individual pieces are retained to display their side surfaces.

The package may further include a clear plastic cover dimensioned to extend over the backer.

The display panel surface may further include recessed areas without inserts. Such non-insert recessed areas may be formed to retain a single place setting of flatware pieces. The single place setting pieces may be retained (directly by the backer) to display their front surfaces.

DETAILED DESCRIPTION

Figure 1:
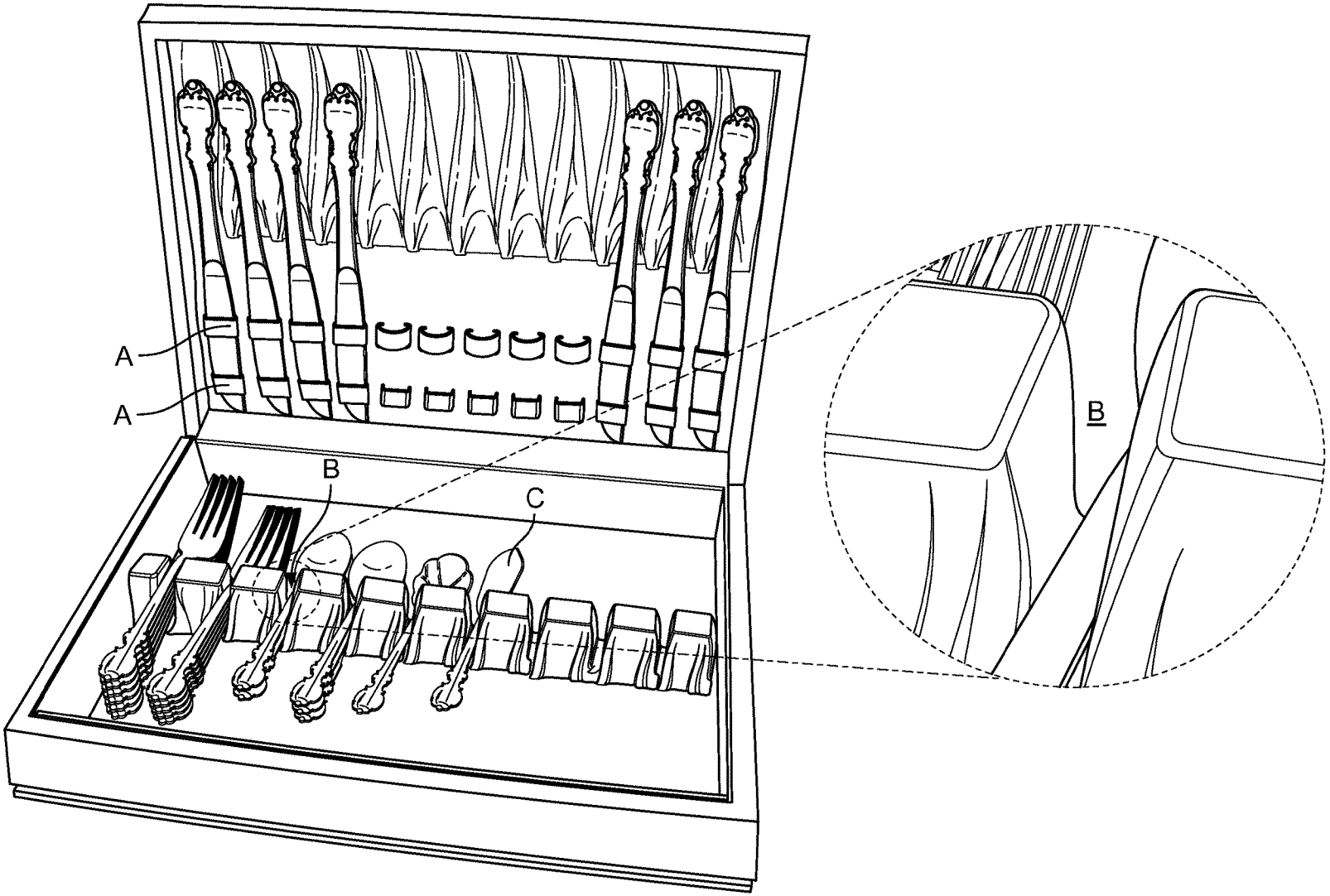
FIG. 1 (Prior Art)
FIG. 1 is a perspective view of a flatware storage box with inset showing recesses for placement (PRIOR ART).
Figure 2:
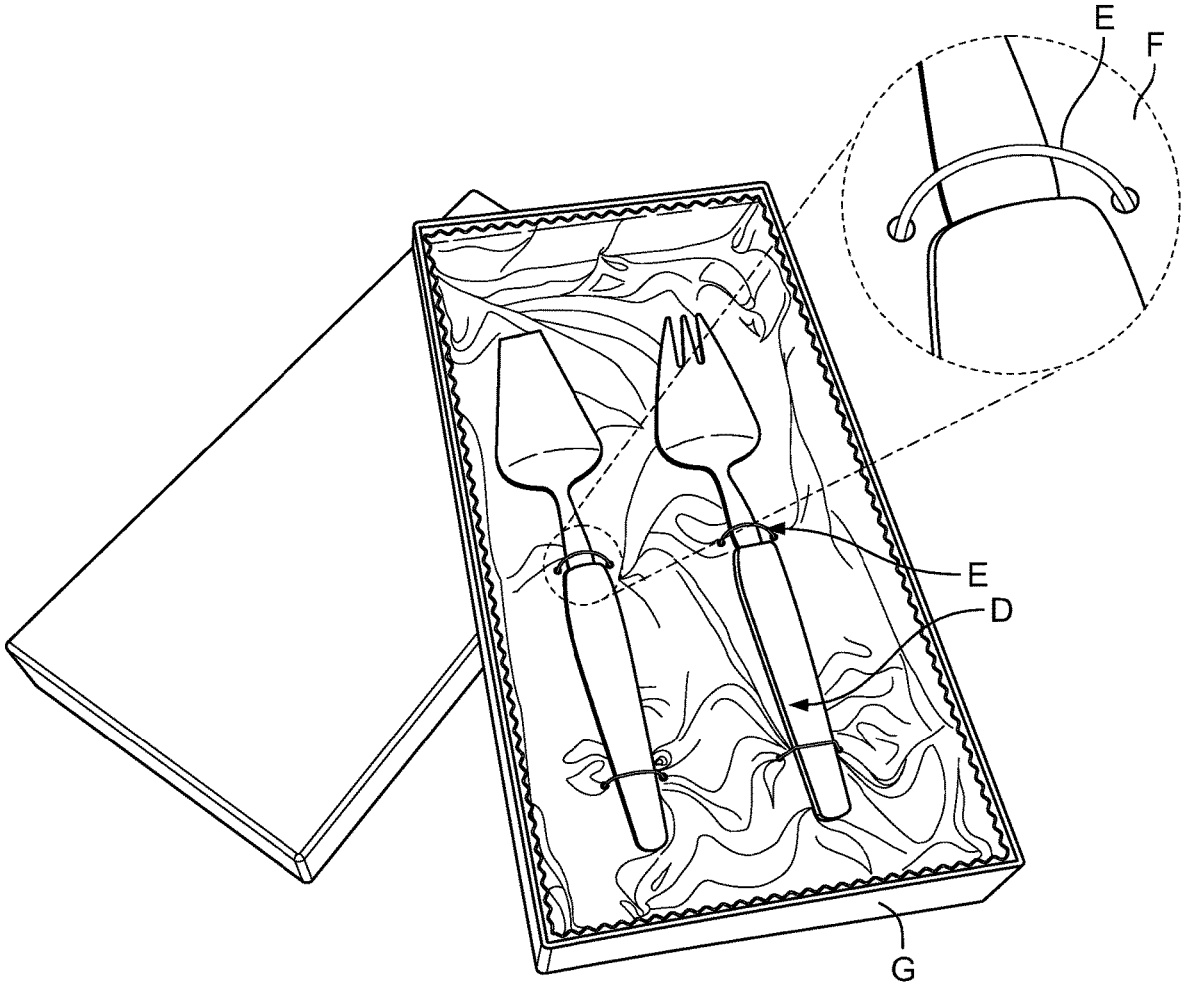
FIG. 2 (Prior Art)
FIG. 2 is a perspective view of a flatware display box with pieces retained by ties (PRIOR ART).
Figure 3:
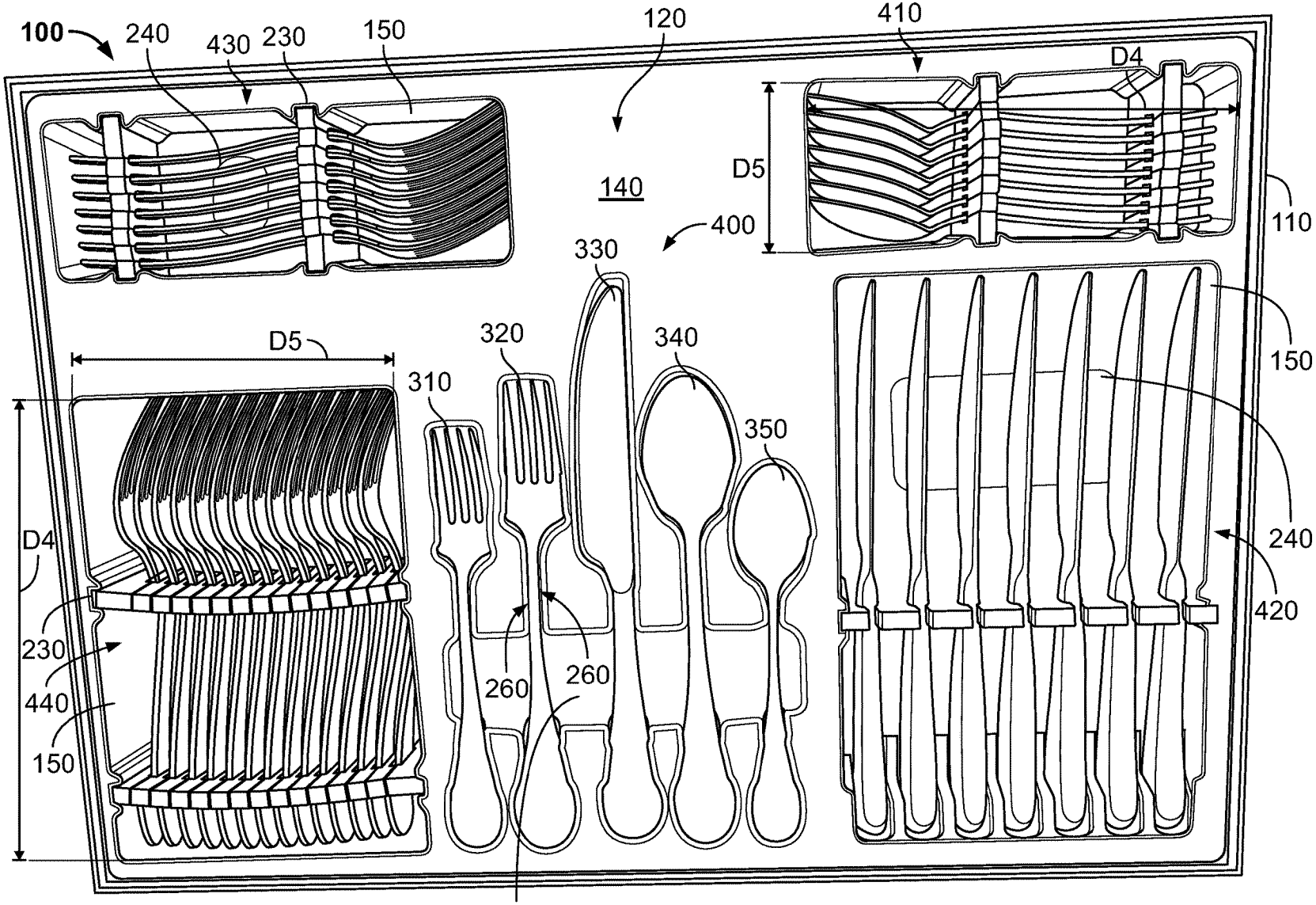
FIG. 3 is a top view of a preferred embodiment of the present display package.
Figure 4:
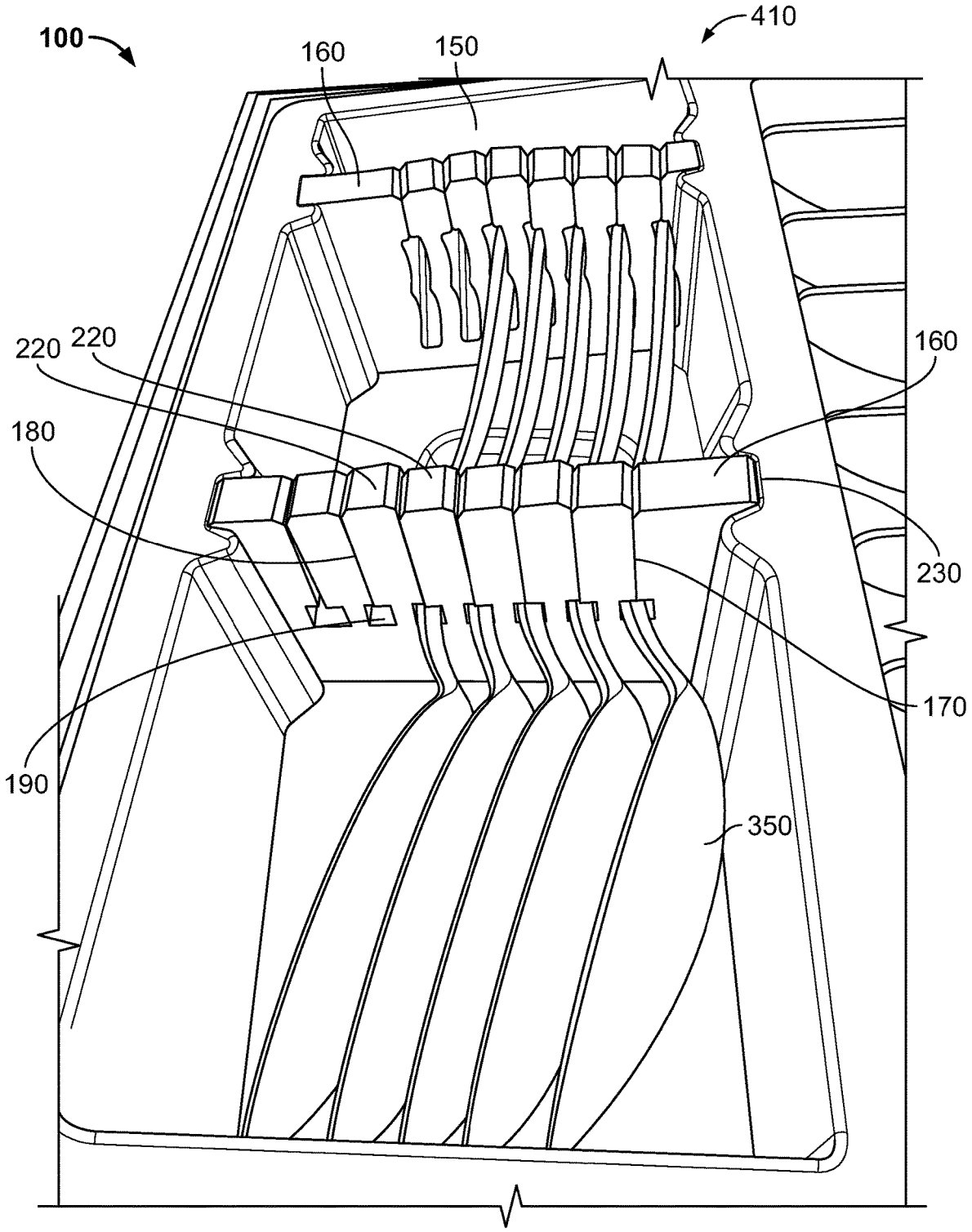
FIG. 4 is a detail view of teaspoon section of the display package.
Figure 5:
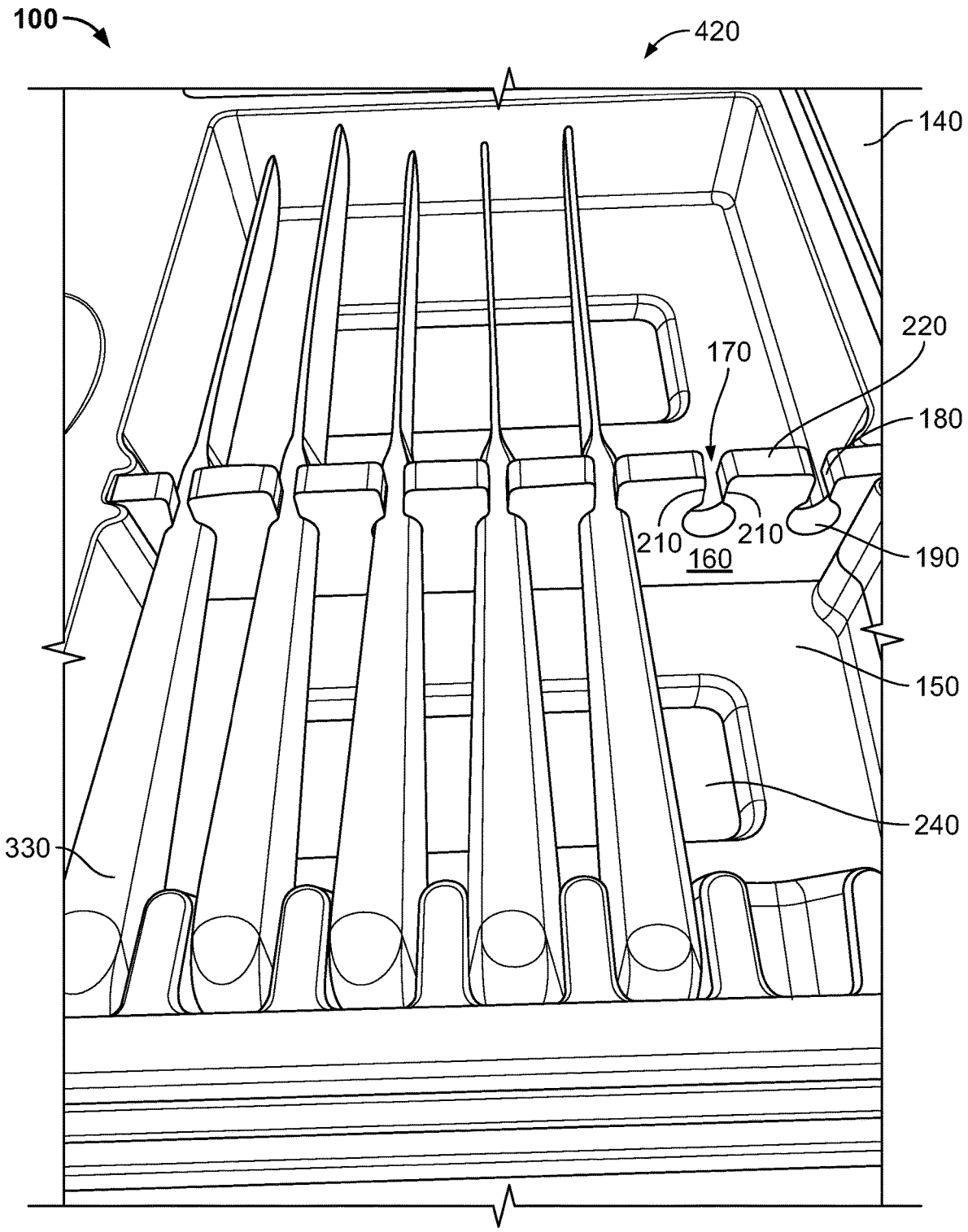
FIG. 5 is a detail view of a knife section of the display package.
Figure 6:
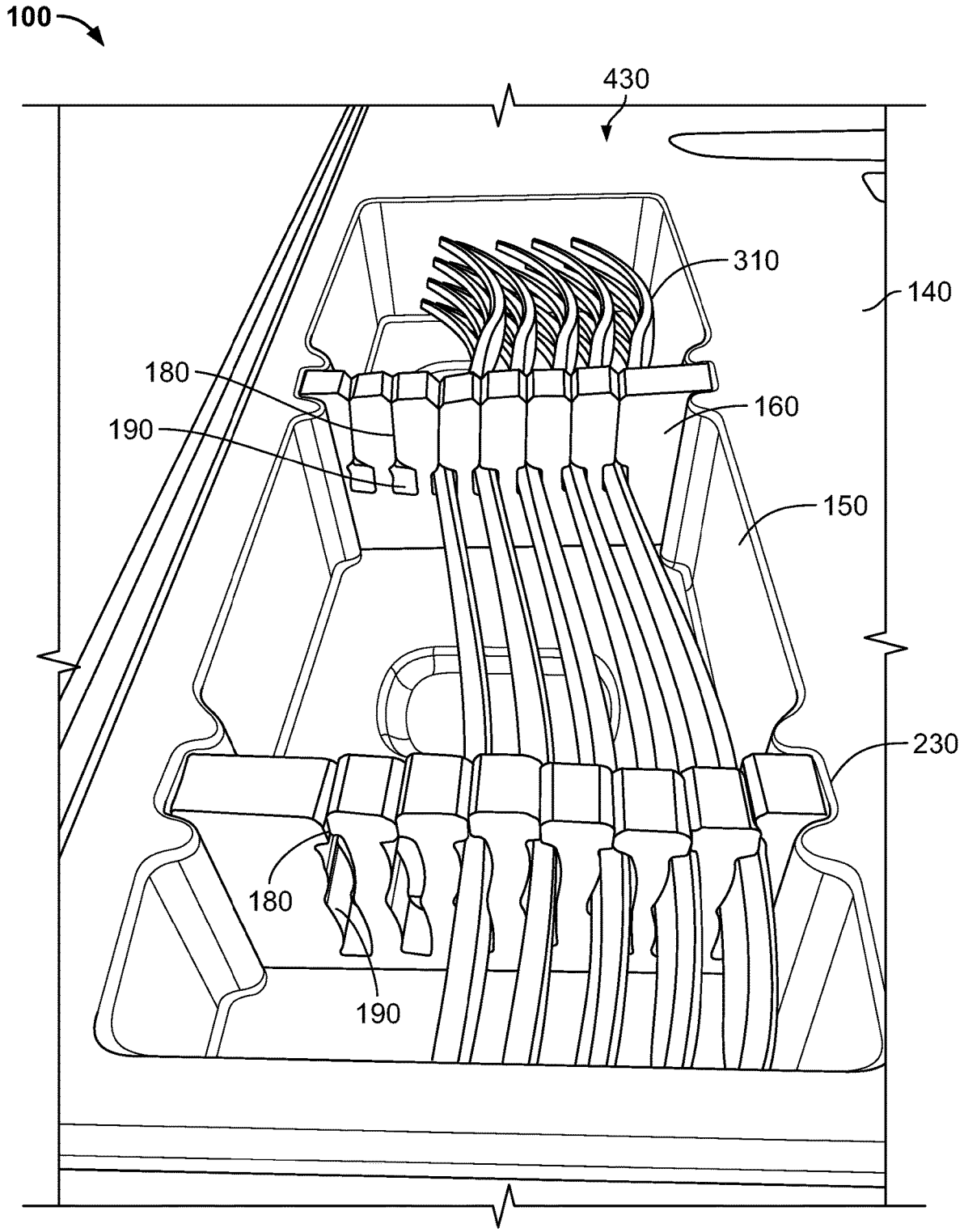
FIG. 6 is a detail view of a dessert fork section of the display package.
Figure 7:
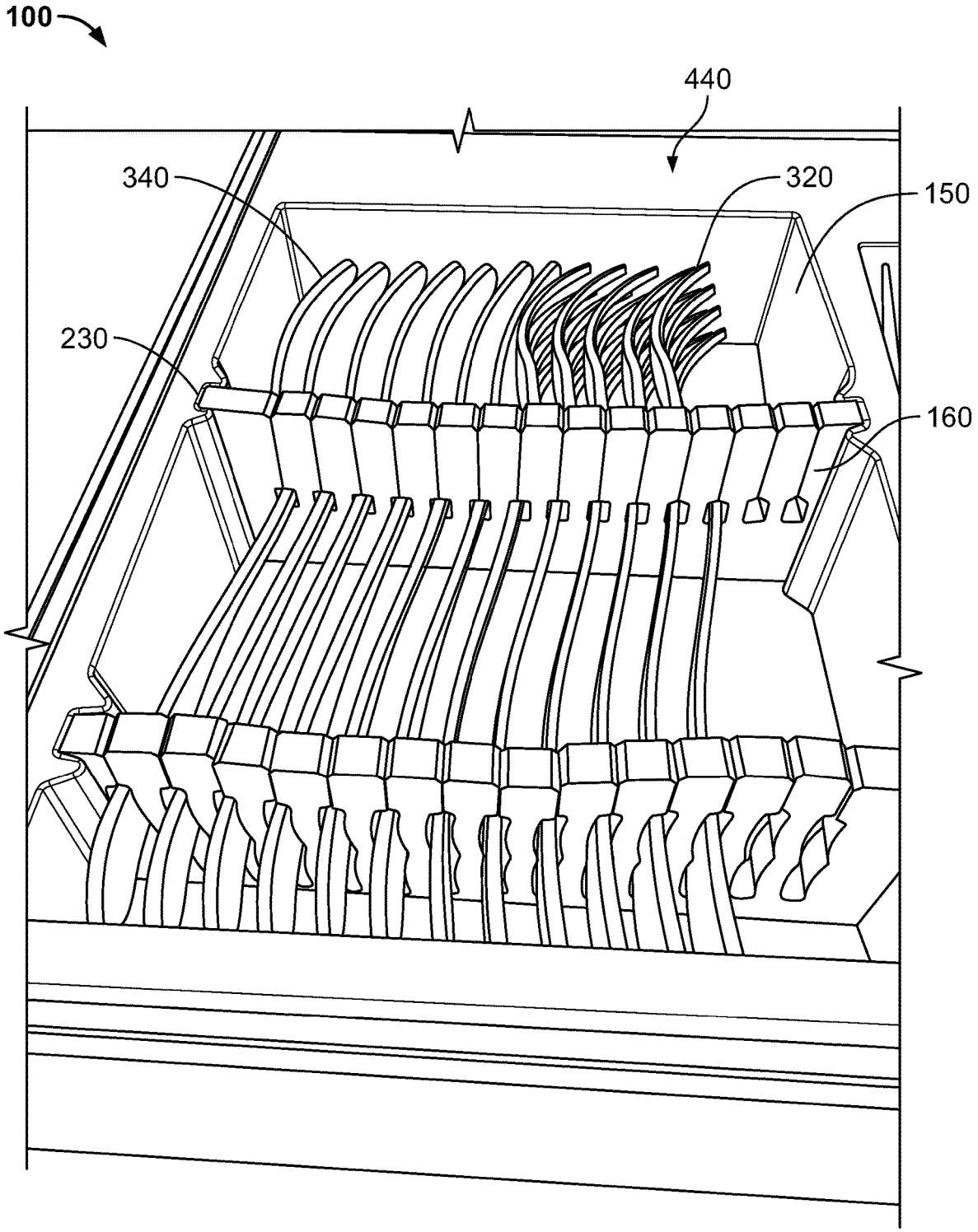
FIG. 7 is a detail view of a dinner fork and tablespoon section of the display package.

A tieless flatware display package 100 is provided, as shown in FIG. 3. The package preferably includes a box 110 (e.g. rigid paperboard) with a formed backer 120 positioned inside. An opaque (or preferably clear) cover 130 (e.g. of clear plastic) may be provided. These layers are shown notionally in FIG. 10.

The backer may be divided into separate holding and display sections. These may correspond generally with the types of flatware in the set, so for example:

Small spoons 350 in a small spoon area 410;

Knives 330 in a knife area 420;

Small forks 310 in a small fork area 430;

Large forks 320 and large spoons 340 in a large fork/large spoon area 440.

A single place setting may also be displayed in a portion 400 of the backer 120. As shown in FIG. 3, this setting may be displayed front-facing, unlike the grouped sections 410-440 which are displayed on their sides for efficiency and to show side features. The single place setting may be retained solely by pressure-fit in specially shaped recesses directly in the backer with optional detent surfaces 260.

In order to replace ties/straps in the grouped sections, shaped inserts 160 are provided that retain the individual pieces, and prevent them from rattling or falling out when the package is displayed upright.

The backer is preferably provided with recesses 150 for each of the grouped sections. These are areas sunk below the highest planar level of the display backer at surface 140. The inserts 160 are sunk into insert recesses 230 within these recessed areas 150. Each recessed area 150 may also include one or more wells 240 (i.e. areas sunk below the lowest depth of the recessed area) to make it easier for the consumer to reach under a flatware piece to remove it from the insert. A similar well(s) 250 may be provided below the individual place setting pieces at region 400 for a similar purpose.

Figure 10:
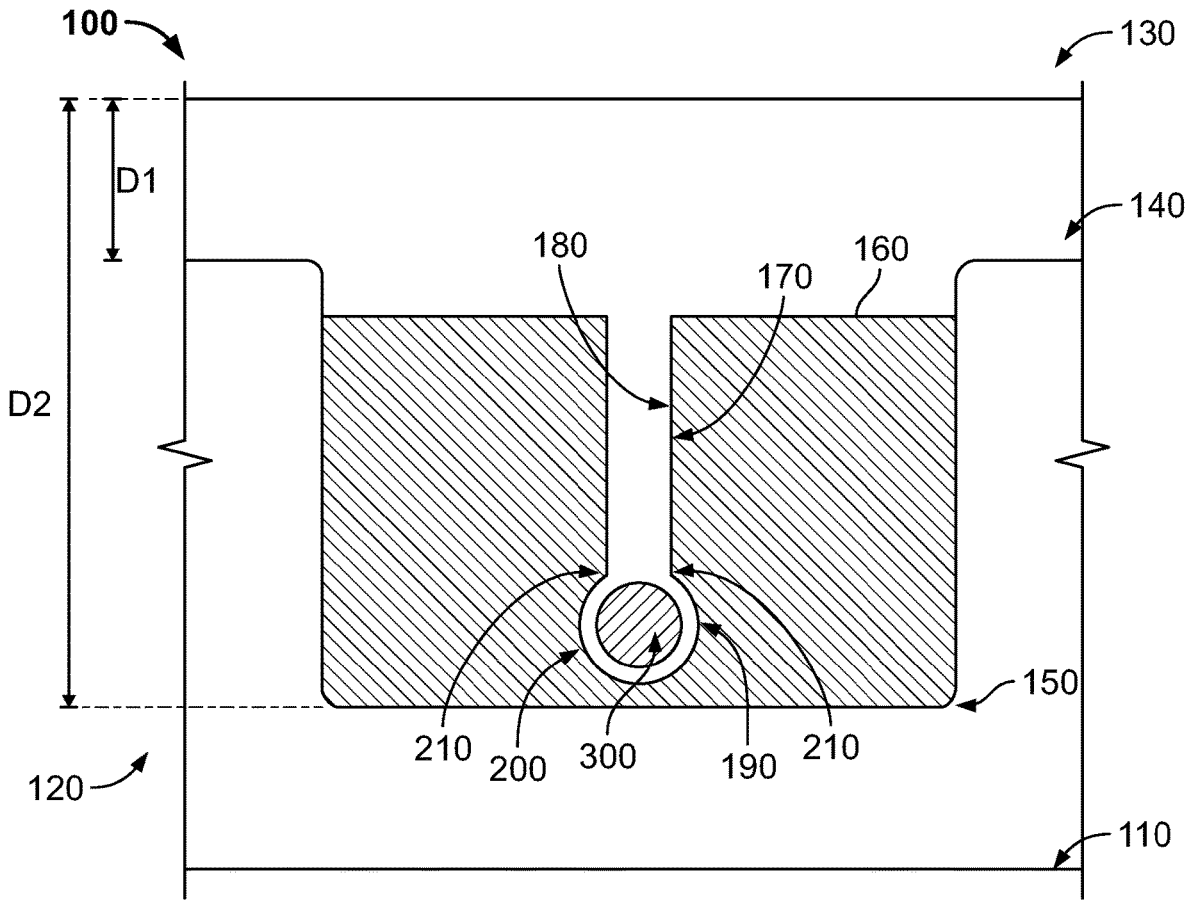
FIG. 10 is a sectional view showing relative depths of parts of the package.

So, looking at FIG. 10, taking the cover 130 as a reference point, the panel surface 140 of the display backer is at a first depth D1 in the box 110. The recess 150 of this same backer is at a second lower depth D2. The insert 160 with slots 170 is in this recess. The optional well 240 (not shown in this Figure) would be at a third lower depth extending below the recess 150.

The grouped sections 410-440 are shown in more detail in FIGS. 4-7.

The display backer is preferably a unitary sheet of polystyrene or equivalent that has been molded or formed (e.g. vacu-formed) with the desired surface features, recesses, wells, indents, etc.

Each recess 150 preferably has a longitudinal dimension (and direction) (D4) and a latitudinal dimension (and direction) (D5). These follow the intended orientation of the flatware pieces in each recess. The long direction is the longitudinal one, while the short direction is the latitudinal one, but the absolute orientation of these relative to the box can differ by section (see FIG. 3, comparing sections 410-440). The insert recess 230 and the insert 160 run in the latitudinal direction. Each insert 160 extends completely across the associated recess 150 in the latitudinal direction. The insert may be glued, taped or simply press-fit into the insert recess, which is preferably sized/shaped to fit the insert.

Figure 9:
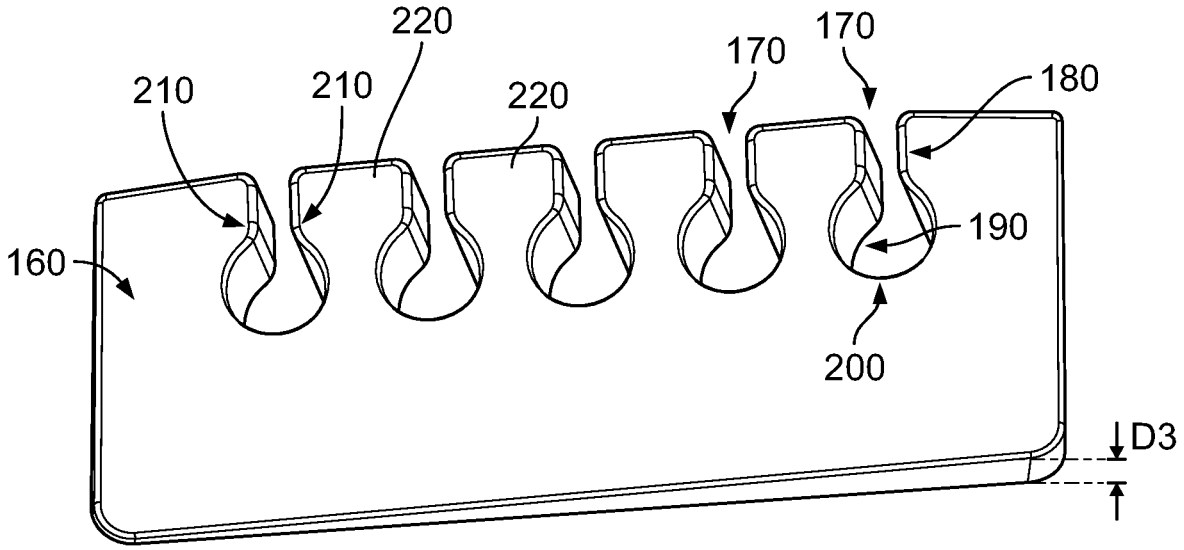
FIG. 9 is a detail view of a sample insert showing shaped slots.

The insert pieces 160 that are lodged in the insert recesses 150 are preferably made of closed cell cured resilient foam such as ethylene-vinyl acetate (EVA) foam. One embodiment of an insert is shown in isolation in FIG. 9. The insert has a thickness (D3) that is preferably about 5-10 mm.

The insert has carved, cut or formed slots 170 that allow the individual flatware pieces to be lodged and retained. The resilience and density of the foam allows the pieces to be removed and reinserted as many times as desired without damage to the box or loss of function. The slots preferably have unique geometry to account for the diverse dimensions and shapes of the individual flatware pieces. Even different portions along the length of an individual piece may be retained by different shaped slots (e.g. lower handle of a fork vs. upper handle) to account for their different cross-sections.

Speaking generally, each slot 170 has a relatively narrow neck 180 and a relatively wider holding area 190. The narrow neck may be literally just a slit, as seen in the inserts in FIG. 4, for example. Or, it may be a relatively narrow gap through which the flatware piece can pass with a certain amount of resistance before seating in the holding area 190. Shoulders 210 of the slot retain the flatware piece once lodged. The shoulders may be the same width apart as the neck or even narrower. Importantly, the neck (or at least the shoulders) should be narrower than the flatware item 300 (shown notionally in FIG. 10), so that the piece does not fall out when the box is lifted to upright.

Figure 8:
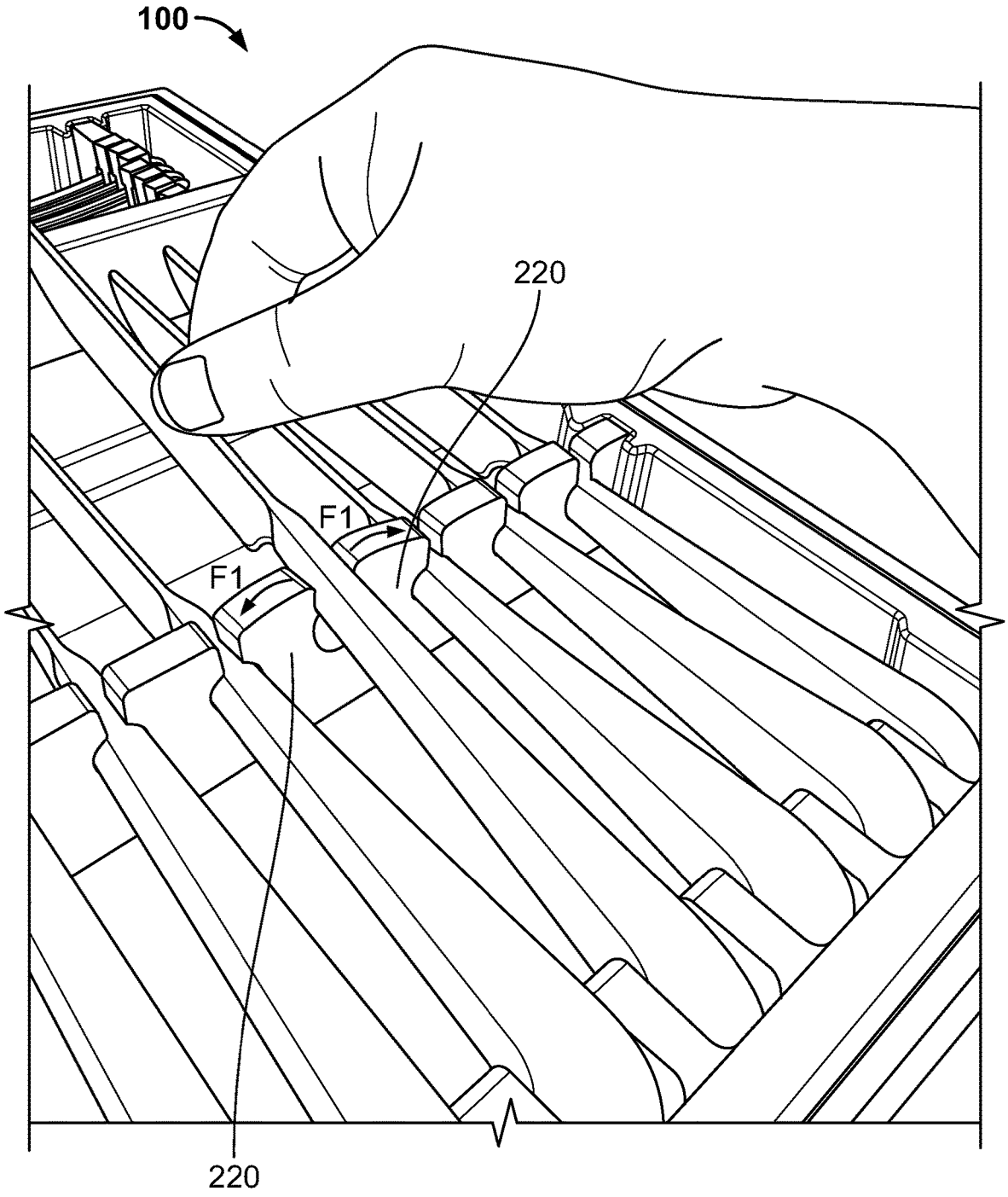
FIG. 8 is a detail view of the insertion/removal of an individual knife from the insert.

Each insert preferably has multiple slots 170. These are spaced at preferably regular intervals. The foam portions between adjacent slots can be thought of as springy sort of "fingers" 220. These fingers may compress slightly and splay apart (in direction F1—see FIG. 8) while a flatware piece is being inserted or removed and then return to the original position and shape once the flatware piece is fully inserted up to slot base 200 or fully removed from the slot 170.

The density of the EVA foam is preferably at least about 0.10 g/cm$^2$, and more preferably at least about 0.15 g/cm$^2$.

The overall structure of the box with the backer and inserts allows the flatware set to be displayed attractively and in many cases completely. The consumer gets a full appreciation for the entire set while it is displayed in the store, and has the benefit of a reuseable storage box for the set when at home. The individual slots also allow the consumer to see if an individual piece is missing or bent. Because of the strength of the resilient inserts, the pieces are kept in non-rattling security. The box can be displayed upright, and also stored in an upright (vertical) configuration indefinitely. The tieless construction means that the consumer has ready access without the need to cut or untangle ties and all the attendant hassles.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

What is claimed is:

1. A tieless display package for flatware pieces, comprising:

a rigid paperboard box;

a formed backer sized to fit snugly within the box, the backer having a display panel surface at a first depth in the box;

at least one recessed area having a longitudinal dimension and a latitudinal dimension and having a second depth deeper than the first depth;

an insert recess running across the recessed area in the latitudinal dimension and having a depth equivalent to the second depth;

a resilient foam insert securely set into the insert recess which extends approximately between the first depth and the second depth, the insert having shaped slots for inserting individual flatware pieces, each shaped slot having:

a relatively narrow neck proximate to the first depth, and a relatively wider holding area under the narrow neck below the first depth but terminating before the second depth;

wherein an individual flatware piece is inserted into the slot by squeezing the piece through the relatively narrow neck to seat the piece in the wider holding area, the foam of the slot's narrow neck reclosing over the individual flatware piece after insertion to capture it in the holding area.

2. The package of claim 1, wherein the backer is of polystyrene.

3. The package of claim 1, wherein the backer is of vacuum formed polystyrene.

4. The package of claim 1, wherein the insert is of ethylene vinyl acetate (EVA) foam.

5. The package of claim 1, wherein the insert is of EVA foam having a density of at least 0.1 g/cm$^2$.

6. The package of claim 1, wherein the insert is of EVA foam having a density of at least 0.15 g/cm$^2$.

7. The package of claim 1, wherein each insert has multiple slots.

8. The package of claim 1, wherein an individual insert has matching slots.

9. The package of claim 1, wherein the slots are waterjet or die-cut.

10. The package of claim 1, wherein the holding area is sized to fit a portion of the individual piece within the recess.

11. The package of claim 1, comprising a plurality of recessed areas, each having at least one insert in at least one insert recess, and wherein each recessed area is for a grouping or type of flatware.

12. The package of claim 11, wherein at least two of the inserts have non-matching slots.

13. The package of claim 1, wherein the package includes slots for all individual pieces of a set of flatware.

14. The package of claim 13, wherein the individual pieces are retained to display their side surfaces.

15. The package of claim 1, further comprising a clear plastic cover dimensioned to extend over the backer.

16. The package of claim 1, wherein the display panel surface further includes recessed areas without inserts.

17. The package of claim 16, wherein the non-insert recessed areas are formed to retain a single place setting of flatware pieces.

18. The package of claim 17, wherein the single place setting pieces are retained to display their front surfaces.

* * * * *